US006712066B1

(12) United States Patent
Atkinson et al.

(10) Patent No.: US 6,712,066 B1
(45) Date of Patent: Mar. 30, 2004

(54) REAR ALIGNMENT AND SUPPORT SYSTEM FOR A COOKING APPLIANCE COOKTOP

(75) Inventors: Wade A. Atkinson, Ooltewah, TN (US); Val Briedis, Cleveland, TN (US); Charles Looney, Athens, TN (US); Mark A. Pickering, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/410,139

(22) Filed: Apr. 10, 2003

(51) Int. Cl.[7] ..... F24C 15/10

(52) U.S. Cl. ..... 126/214 R; 126/211; 126/39 B; 219/452.11

(58) Field of Search ..... 126/19 R, 20 R, 126/214 R, 211, 214 A, 214 C, 39 R, 37 A, 37 B, 39 N; 219/452.11, 452.12, 458.1; 312/263, 228, 279

(56) References Cited

U.S. PATENT DOCUMENTS 2,890,462 A 6/1959 Ross
2,992,315 A 7/1961 McDonnold
3,338,232 A 8/1967 Heldendrand
4,869,231 A 9/1989 Rice et al.
5,215,074 A * 6/1993 Wilson et al. ..... 126/214 R
5,584,549 A * 12/1996 Lybarger et al. ..... 312/265
5,611,609 A 3/1997 Katz et al.
5,685,623 A 11/1997 Katz et al.
6,263,869 B1 7/2001 Abernethy

* cited by examiner

*Primary Examiner*—James C. Yeung
(74) *Attorney, Agent, or Firm*—Diederiks & Whitelaw, PLC

(57) ABSTRACT

A cooking appliance includes a cabinet, defined by at least front, side, bottom and back panel portions, a pair of laterally spaced end caps provided at an upper rear portion cabinet, and a range top mounted upon an upper portion of the cabinet. At least two sets of alignment components, with each set of alignment components being defined by cooperating first and second sets of alignment elements, are provided on the end caps and range top respectively. When the range top is mounted upon the cabinet, the sets of alignment components become interengaged to automatically, laterally center and mount the range top with respect to the cabinet.

20 Claims, 4 Drawing Sheets

REAR ALIGNMENT AND SUPPORT SYSTEM FOR A COOKING APPLIANCE COOKTOP

BACKGROUND OF THE INVENTION

1. Field of the Invention

The present invention pertains to the art of cooking appliances and, more particularly, to a cooking appliance having a rear alignment and support system for laterally positioning and mounting a range top on the appliance.

2. Discussion of the Prior Art

Cooking appliances in the form of free-standing and slide-in oven ranges are well known. Typically, a cooking operation is performed on a cooking surface defined by one or more of a plurality of heating zones or burners arranged about a range top or, alternatively, in an oven formed within the appliance. Generally, oven ranges have burners mounted directly to the range top or to structure provided below the range top. This structure can take various forms, for example, the burners are mounted directly to the range top, to the appliance chassis, to rails extending below the range top or, in some cases, to flexible mounting structure carried either by the chassis or other support structure provided below the range top. In any event, it is important for the manufacturer to provide a means to access the area below the cooktop, such as for servicing of mechanical and electrical components, or to clean-up after spills occurring on the range top.

Manufacturers have developed a variety of methods for mounting range tops to appliance cabinets so as to allow either a consumer or service technician to access the area immediately below the cooking surface. These methods range from providing hinges on the range top to allow it to swing upwardly to expose the mechanical and electrical components, to attachments in the form of tab and slot arrangements between a range top and an associated appliance chassis. In the later case, aligning the range top with respect to the appliance is critical when mounting gas burners directly to the range top.

Range top mounted gas burners include structure which interconnects the burner to gas delivery elements, typically gas supply piping. Without proper alignment, the attachment components cannot interengage, resulting in the gas burner being improperly aligned with the gas supply structure. When the gas burner and gas supply are misaligned, the overall efficiency of the burner is greatly reduced.

Based on the above, there exists a need in the art for a system to properly secure and align a range top to a cooking appliance. More specifically, there exists a need in the art for a system that readily aligns the range top and associated burner elements with respect to the appliance, while additionally serving as attachment structure for securing the range top to the appliance.

SUMMARY OF THE INVENTION

The present invention is directed to a cooking appliance including a cabinet and a range top. The cabinet is generally defined by a front portion, opposing side panels, a bottom panel and a back panel, while the range top is mounted to the cabinet. More specifically, a plurality of heating elements, which in the preferred form of the invention, are defined by gas burner elements, are arranged about the range top. The cabinet also includes a control panel having an associated pair of laterally spaced end caps provided at side portions thereof.

In accordance with a preferred form of the invention, the cooking appliance includes two sets of alignment components, with each set of alignment components being defined by cooperating first and second sets of alignment elements. Preferably, the first set of alignment elements is provided on the range top and the second set of alignment elements is provided on each of the laterally spaced end caps. With this construction, when the range top is mounted upon the cabinet, the first and second sets of alignment elements become interengaged to laterally position the range top with respect to the cabinet.

In accordance with the most preferred form of the invention, the second set of alignment elements are constituted by tab members projecting from side portions of each of the pair of laterally spaced end caps. More specifically, the second set of alignment elements includes a first or upper tab member and a second or lower tab member. Preferably, the upper tab member is defined by a flat, blade-like tab, while the lower tab member is defined by an in-turned tab element adapted to engage with an inner side portion of the range top. With this construction, the lower tab member outwardly biases the range top resulting in the range top being properly aligned with respect to the cabinet.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
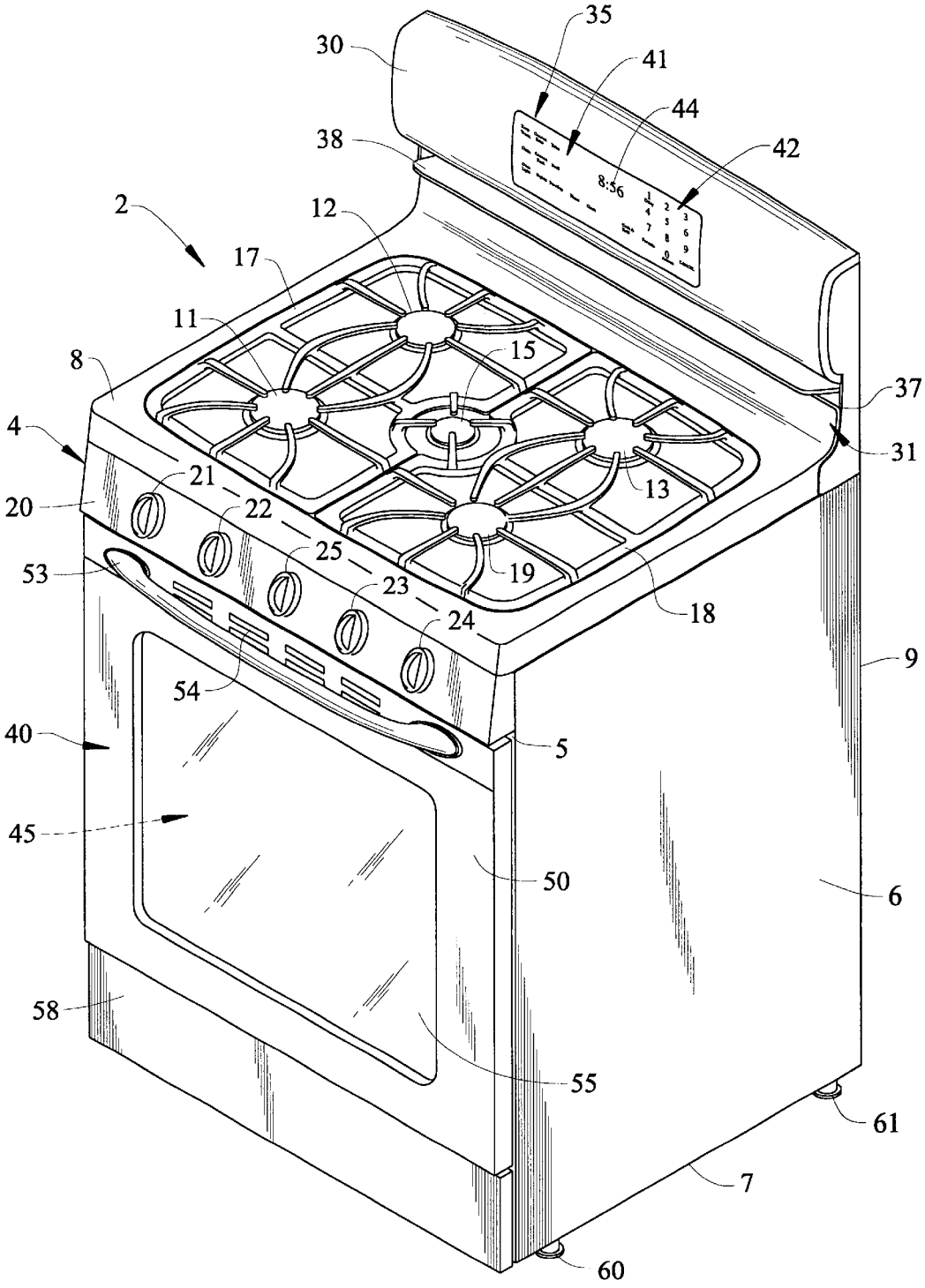
FIG. 1 is an upper right front perspective view of a cooking appliance incorporating a rear range top alignment and support system constructed in accordance with a preferred embodiment of the present invention.

With initial reference to FIG. 1, the present invention is preferably incorporated into a cooking appliance generally indicated at 2. As shown, cooking appliance 2 takes the form of a free-standing gas range. Range 2 includes a cabinet 4 having a front panel portion 5, opposing side panel portions 6, a bottom portion 7, a range top 8, and a main back panel 9. Within the scope of the invention, range top 8 can take on various forms. In the preferred embodiment shown, range top 8 is provided with five gas burner elements 11–15, i.e., four outer quadrant gas burner elements 11–14 and a central gas burner element 15, which are covered by left and right, mirror image burner grates 17 and 18.

In the embodiment illustrated, cabinet 4 further includes a front control surface 20. Preferably, control surface 20 supports a plurality of control knobs 21–25 for controlling the activation/de-activation of gas burners 11–15 respectively. Furthermore, cabinet 4 includes an upstanding control panel 30 arranged at an upper rear portion 31 of cabinet 4. In the embodiment shown, control panel 30 includes a central control and display unit, generally indicated at 35. Control panel 30 is provided above an exhaust outlet opening 37 extending across upper rear portion 31 and having an associated exhaust deflector 38 for directing an exhaust airflow away from control panel 30 and central control and display 35.

In the preferred form of the invention, central control and display 35 is provided for use in controlling an oven 40 of range 2. Although not fully detailed in this figure, control and display unit 35 includes a first control section 41 for selecting a desired cooking operation for oven 40. For instance, a user can select between keep warm, convection bake, bake, clean convection broil, broil, drying, and bread proofing operations. In connection with setting desired cooking parameters, control and display unit 35 also includes a second control section 42 which defines a numeric key pad. At this point, it should be realized that the arrangement and features associated with control panel 30 can vary without departing from the invention. For instance, in addition to other standard controls, such as timer and clock setting elements, control panel 30 can provide for other operations, such as a "cook and hold" feature wherein oven 40 operates to maintain food cooked therein warm following a cooking operation or a "favorite" selector which can be employed to readily establish a predetermined, preferred cooking sequence for oven 40. In any event, control and display unit 35 further includes a central display 44 for conveying information to and verifying input/operational parameters to a user.

In the preferred embodiment, oven 40 includes an oven cavity 45 which is larger than an oven cavity of a standard range. More specifically, wherein the volume of a standard oven cavity for a range would be in the order of 4.0 cubic feet, oven cavity 45 is approximately 5.2 cubic feet. In accordance with the present invention, oven cavity 45 is preferably formed of metal and coated with a heat resistant material, such as porcelain. In any case, oven 40 has associated therewith a door 50 which can be pivoted by means of a handle 53. Door 50 preferably includes a plurality of vents 54 arranged behind handle 53 and a window 55 for viewing the contents of oven cavity 45 when door 50 is closed. Arranged below door 50 and extending across cabinet 4 is a lower face panel 58.

In a manner known in the art, range 2 is adapted to be mounted upon a supporting surface, such as a kitchen floor or the like. More specifically, a plurality of leg members, two of which are indicated in FIGS. 1 at 60 and 61, extend from bottom portion 7 at front and rear portions of cabinet 4, along side panel 6. Of course, corresponding leg members 60 and 61 are also provided on the opposing side of range 2. In any event, the various leg members 60 and 61 are preferably vertically adjustable to also act as levelers for range 2. Such type of leg leveler arrangements are widely known in the art of appliances, including both ranges and refrigerators such that the leveling function of leg members 60 and 61 does not form part of the present invention. Instead, the invention is actually directed to a rear alignment and support system for cooktop 8 as will be more fully discussed below.

Figure 2:
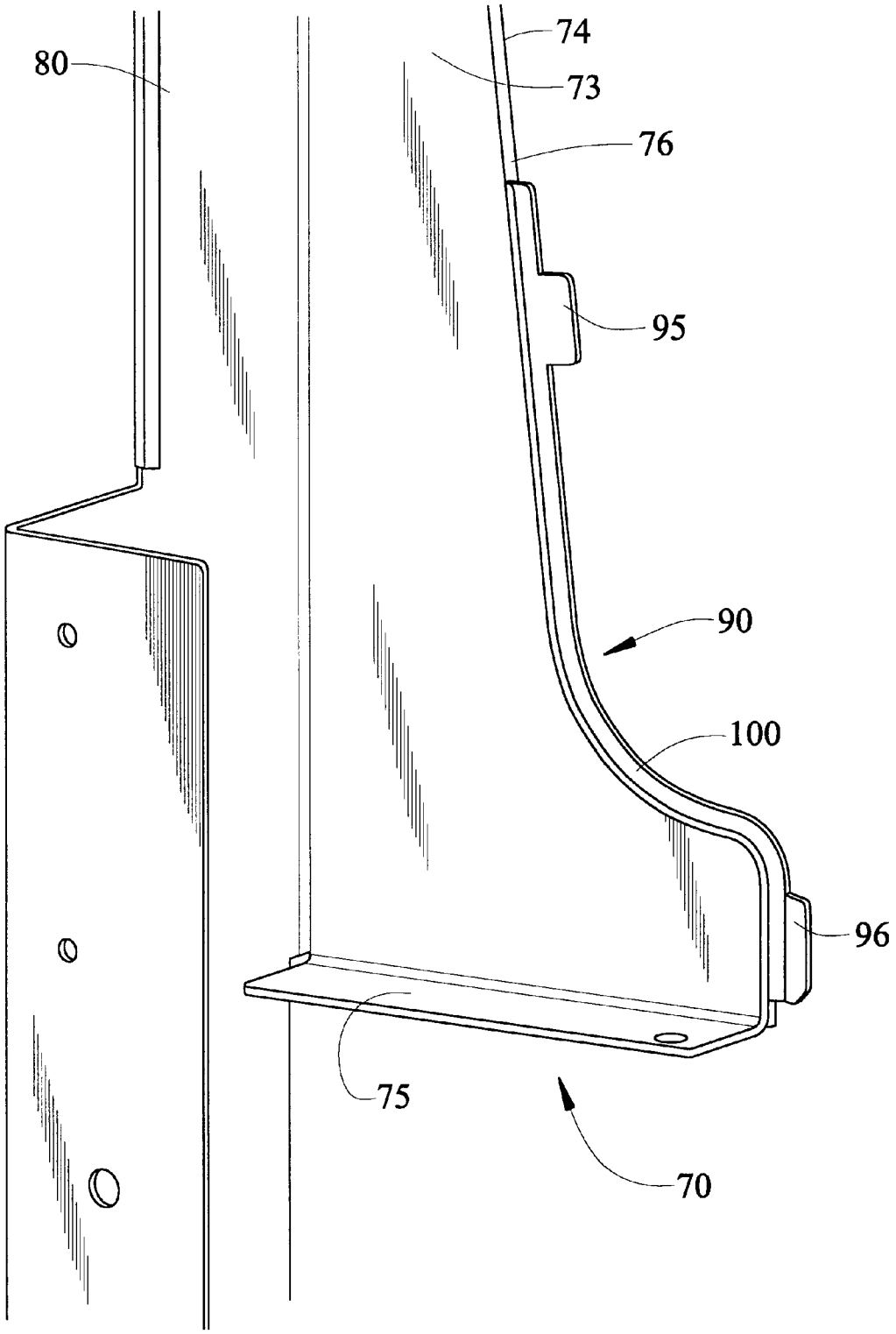
FIG. 2 is a partial perspective view of an end cap of the cooking appliance having projecting therefrom alignment components of the rear alignment and support system in accordance with the present invention.
Figure 3:
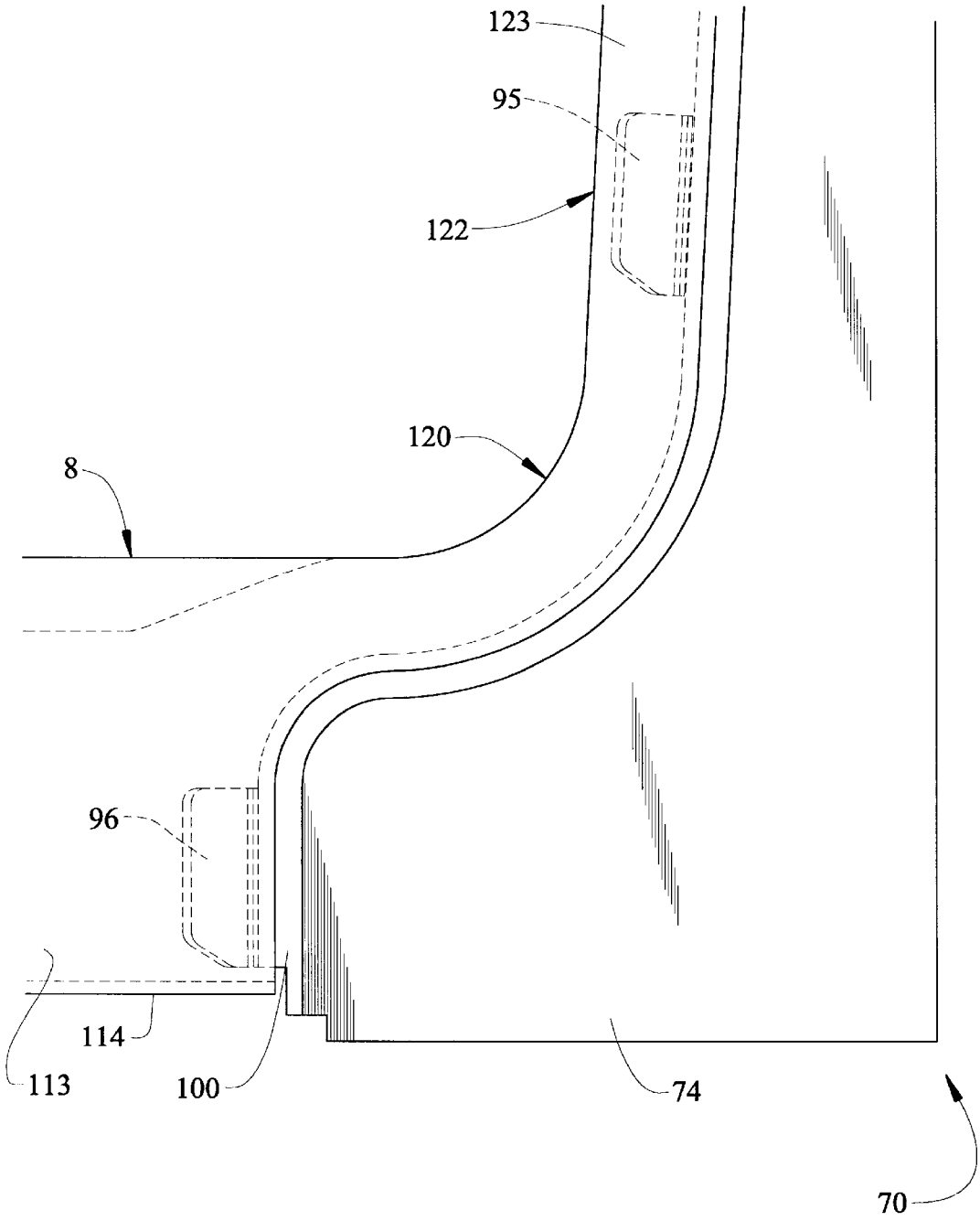
FIG. 3 is a right side elevational view of a portion of the end cap and range top of FIG. 2.
Figure 4:
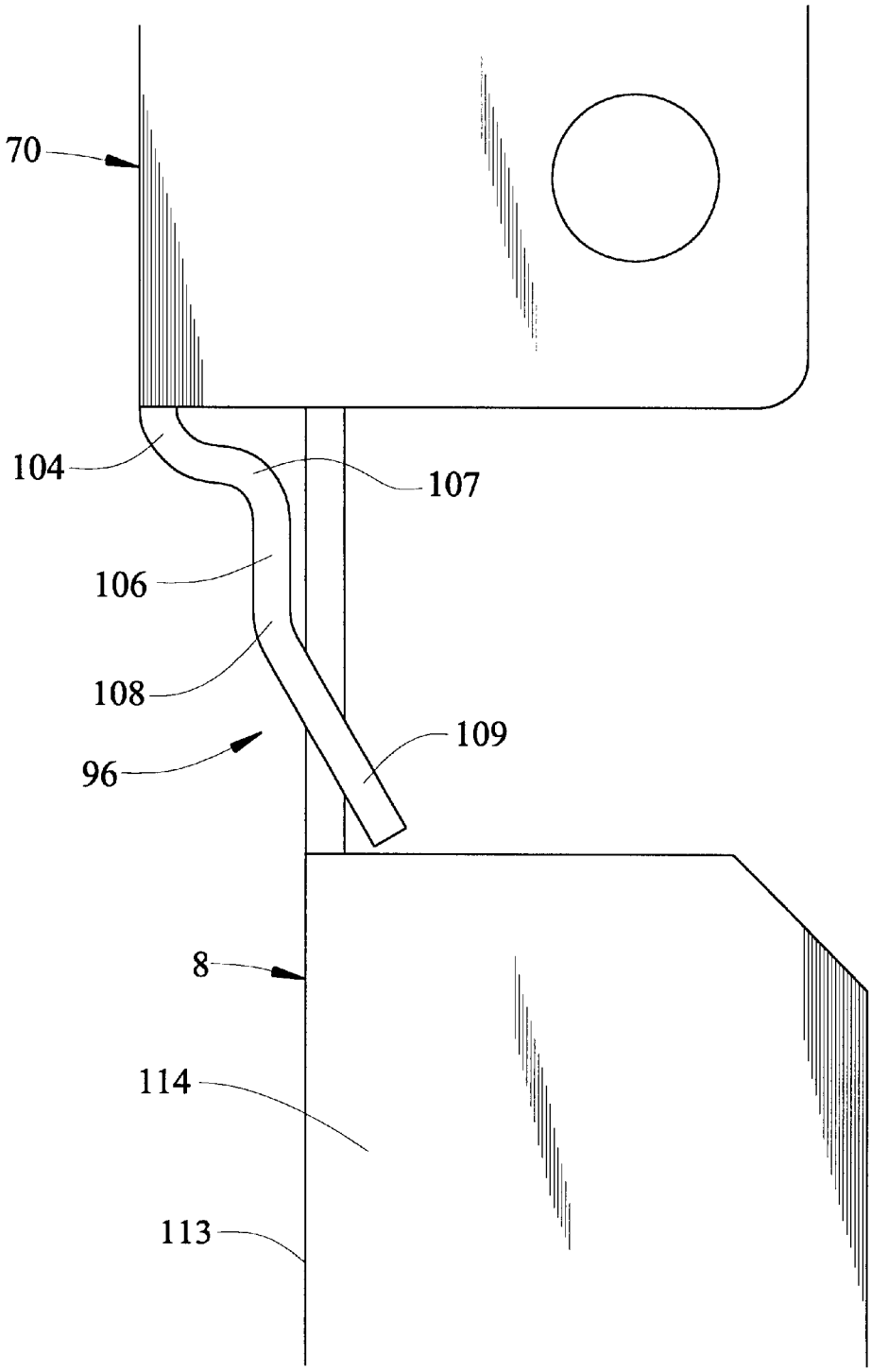
FIG. 4 is a bottom plan view of the end cap and range top of FIG. 2.

In the embodiment shown, cooking appliance 2 includes a pair of end caps 70 and 71 provided at upper rear portion 31 of cabinet 4. Actually, end caps 70 and 71 are partially formed from a frame sub-assembly 80 that serves as the underlying support structure for cabinet 4 and, by extension, cooking appliance 2. In any event, end caps 70 and 71 are laterally spaced and support, at least in part, control panel 30. Reference will be made below to FIGS. 2–4 in describing the specific structure of end caps 70 and 71 in accordance with the invention. However, since the structure of each end cap 70, 71 is identical, a detailed description of end cap 70 will be made and it is to be understood that end cap 71 has commensurate structure.

As best seen in FIG. 2, end cap 70 includes a first or inside portion 73, a second or outside portion 74, a bottom portion 75 and a front edge portion 76. In accordance with a preferred form of the invention, end cap 70 is provided with an upper tab member 95 projecting from an intermediate portion of end cap 70 and a lower tab member 96 projecting from a lower portion of end cap 70. More specifically, upper tab member 95 is preferably constituted by a flat blade-like projection and, as will be discussed more fully below, lower tab member 96 is constituted by in-turned element projecting toward a central portion of cooking appliance 2. As best seen in FIG. 2, upper and lower tab members 95 and 96 extend from a forwardly projecting stepped edge section 100 provided on front edge portion 76 of end cap 70. As shown, edge section 100 forms a stepped region which is adapted to receive range top 8 as shown in FIG. 3 and discussed more fully below.

With reference to FIG. 4, lower tab member 96 includes a first in-turned section 104 extending outwardly from edge section 100. As shown, first in-turn section 104 leads to an intermediate section 106 through a curved section 107. Intermediate section 106 extends substantially parallel to side panel portion 6 of cooking appliance 2 and thereafter leads to a second in-turned section 108 terminating in an angled section 109. Lower tab member 96 is adapted to engage with a side portion 113 extending above a bottom portion 114 of range top 8. Actually, lower tab member 96 is outwardly biased when top 8 is fully mounted upon cabinet 4. That is, during mounting, range top 8 is shifted rearward toward control panel 30, whereupon side portion 113 engages with lower tab member 96 forcing lower tab member 96 to slightly deflect laterally inwardly while forcing range top 8 to be laterally centered with respect to cabinet 4 as further discussed below.

In further accordance with the most preferred embodiment, range top 8 includes an up-swept section 120 (see FIG. 3) including laterally opposing up-swept end portions 122 having an inner side surface 123 adapted to engage with upper tab member 95. That is, inner side surface 123 of up-swept section 120 and side portion 113 include structure which interengage with upper and lower tab members 95 and 96. Actually, lower tab member 96 and side portion 113 constitute first and second alignment elements of a first alignment component, with a second alignment component being similarly arranged on the opposing end cap 70. Similarly, upper tab member 95 and side portion 123 constitute third and fourth alignment elements of a third alignment component, with a fourth alignment component being similarly arranged on opposing end cap 70.

With this construction, when range top 8 is mounted upon cabinet 4 and moved rearward, the first and second alignment components interengage to laterally position and mount range top 8 with respect to cabinet 4. Towards that end, as range top 8 is positioned upon cabinet 4 and maneuvered toward upper rear portion 31, upper tab member 95 interengages with inner side surface 123 of up-swept section 120 and second tab member 96 interengages with side portion 113. Of course, it should be apparent that, as second tab member 96 forces side portion 113 outward, range top 8 is laterally centered and aligned with respect to cabinet 4. With this arrangement, it is assured that range top 8 and burner elements 11–15 are properly positioned upon cabinet 4 in a quick and efficient manner. Moreover, as upper and lower tab members 95 and 96 project from stepped edge section 100, once range top 8 engages with end caps 70 and 71 side portion 113 cooperates with stepped edge section 100 such that the two surfaces are flush with one another.

Although described with reference to a preferred embodiment of the present invention, it should be readily apparent to one of ordinary skill in the art that various changes and/or modifications can be made to the invention without departing from the spirit thereof. For instance, while tab members are shown projecting from the end caps, it should be apparent that the tab elements could alternatively be formed projecting from portions of the range top and where the end caps include the mating or cooperating structure. Additionally, while the cooking appliance is shown as a gas range, it should be understood that electric heating elements could be employed, as well as gas elements provided under a smooth top cooking surface. In general, the invention is only intended to be limited to the scope of the following claims.

We claim:

1. A cooking appliance comprising:

a cabinet including at least a front portion, opposing side panels, a bottom panel and a back panel, said cabinet being adapted to rest upon a substantially horizontal supporting surface;

a range top including front, rear and opposing side portions;

a plurality of heating elements arranged about the range top;

a pair of laterally spaced end caps provided at an upper rear portion of the cabinet; and first and second sets of alignment components, each of the first and second alignment components including cooperating first and second alignment elements, said first alignment elements being provided on the laterally spaced end caps and said second alignment elements being provided on the range top wherein, when the range top is mounted upon the cabinet, said first and second alignment elements of each of the first and second alignment components become interengaged to laterally position and mount the range top with respect to the cabinet.

2. The cooking appliance according to claim 1, further comprising: a control panel arranged at the upper rear portion of the cooking appliance, said control panel being supported, at least in part, by the pair of laterally spaced end caps.

3. The cooking appliance according to claim 1, wherein the first alignment elements are defined by first and second tab members.

4. The cooking appliance according to claim 3, wherein each of the first and second tab members project from a lower end portion of a respective one of the laterally spaced end caps.

5. The cooking appliance according to claim 4, wherein each of the first and second tab members includes an inwardly projecting section adapted to engage with a respective one of the opposing side portions of the range top.

6. The cooking appliance according to claim 1, further comprising: third and fourth sets of alignment components, each of the third and fourth sets of alignment components including cooperating third and fourth alignment elements, said third alignment elements being provided on the laterally spaced end caps and the fourth alignment elements being provided on the range top.

7. The cooking appliance according to claim 6, wherein the third alignment elements are defined by flat tab members projecting from an intermediate portion of the laterally spaced end caps.

8. The cooking appliance according to claim 7, wherein the rear portion of the range top is constituted by an up-swept portion including laterally opposing first and second up-swept ends, each of said first and second up-swept ends including a respective side surface defining a tab member receiving section which constitutes a respective one of the fourth alignment elements, wherein the first and second up-swept ends are adapted to engage the laterally spaced end caps with the third alignment elements extending into the tab member receiving sections.

9. A cooking appliance comprising:

a cabinet including at least a front portion, opposing side panels, a bottom panel and a back panel, said cabinet being adapted to rest upon a substantially horizontal supporting surface;

a range top including front, rear and opposing side portions;

a plurality of heating elements arranged about the range top;

a pair of laterally spaced end caps provided at an upper rear portion of the cabinet; and alignment means provided on each of the range top and the laterally spaced end caps for automatically, laterally centering the range top as the range top is mounted on the cabinet.

10. The cooking appliance according to claim 9, further comprising: a control panel arranged at the upper rear portion of the cooking appliance, said control panel being supported, at least in part, by the pair of laterally spaced end caps.

11. The cooking appliance according to claim 10, wherein the alignment means is constituted by first and second sets of alignment components, each of the first and second alignment components including cooperating first and second alignment elements, said first alignment elements being provided on the laterally spaced end caps and said second alignment elements being provided on the range top.

12. The cooking appliance according to claim 11, wherein the first set of alignment elements are defined by first and second tab members.

13. The cooking appliance according to claim 12, wherein each of the first and second tab members project from a lower end portion of a respective one of the laterally spaced end caps.

14. The cooking appliance according to claim 13, wherein each of the first and second tab members includes an inwardly projecting section adapted to engage with a respective one of the opposing side portions of the range top.

15. The cooking appliance according to claim 9, further comprising: third and fourth sets of alignment components, each of the third and fourth sets of alignment components including cooperating third and fourth alignment elements, said third alignment elements being provided on the laterally spaced end caps and the fourth alignment elements being provided on the range top.

16. The cooking appliance according to claim 15, wherein the third alignment elements are defined by flat tab members projecting from an intermediate portion of the laterally spaced end caps.

17. The cooking appliance according to claim 16, wherein the rear portion of the range top is constituted by an up-swept portion including laterally opposing first and second up-swept ends, each of said first and second up-swept ends including a respective side surface defining a tab member receiving section which constitutes a respective one of the fourth alignment elements, wherein the first and second up-swept ends are adapted to engage the laterally spaced end caps with the third alignment elements extending into the tab member receiving sections.

18. A method of aligning a range top on a cooking appliance having a cabinet and a pair of laterally spaced end caps provided at a rear portion of the cabinet comprising:

placing the range top on an upper portion of the cabinet;

sliding the range top toward the rear portion of the cabinet; and automatically, laterally centering the range top on the cabinet by engaging first alignment elements on the laterally spaced end caps with second alignment elements on the range top.

19. The method of claim 18, further comprising: engaging third alignment elements on the laterally spaced end caps with fourth alignment elements on the range top.

20. The method of claim 18, further comprising: positioning an up-swept section of the range top flush with the laterally spaced end caps when the range top is slid toward the rear portion of the cabinet.

* * * * *